US009004650B2

(12) United States Patent
Sakai et al.

(10) Patent No.: US 9,004,650 B2
(45) Date of Patent: Apr. 14, 2015

(54) LIQUID DISCHARGE HEAD, CLEANING METHOD FOR LIQUID DISCHARGE HEAD, LIQUID DISCHARGE APPARATUS, AND SUBSTRATE FOR LIQUID DISCHARGE HEAD

(71) Applicant: Canon Kabushiki Kaisha, Tokyo (JP)

(72) Inventors: Toshiyasu Sakai, Kawasaki (JP); Yuzuru Ishida, Yokohama (JP); Takahiro Matsui, Yokohama (JP); Yoshinori Misumi, Tokyo (JP); Maki Kato, Fuchu (JP); Norihiro Yoshinari, Kawasaki (JP); Ichiro Saito, Yokohama (JP); Kenji Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/247,113

(22) Filed: Apr. 7, 2014

(65) Prior Publication Data

US 2014/0300669 A1 Oct. 9, 2014

(30) Foreign Application Priority Data

Apr. 9, 2013 (JP) ..... 2013-081552

(51) Int. Cl.
*B41J 2/05* (2006.01)
*B41J 2/14* (2006.01)

(52) U.S. Cl.
CPC ..... *B41J 2/14129* (2013.01); *B41J 2/14072* (2013.01)

(58) Field of Classification Search
None
See application file for complete search history.

(56) References Cited

U.S. PATENT DOCUMENTS

2009/0315956 A1* 12/2009 Ishida et al. ..... 347/63

FOREIGN PATENT DOCUMENTS

JP 2008-105364 A 5/2008

* cited by examiner

*Primary Examiner* — Lisa M Solomon
(74) *Attorney, Agent, or Firm* — Canon USA Inc. IP Division

(57) ABSTRACT

A substrate for a liquid discharge head includes an upper protection film that covers at least a region corresponding to each of thermal energy generation elements. The upper protection film and at least one of the upper protection films adjacent to the upper protection film within a liquid chamber are respectively connected to different external electrodes, and a voltage can be applied therebetween via the different external electrodes.

20 Claims, 8 Drawing Sheets

LIQUID DISCHARGE HEAD, CLEANING METHOD FOR LIQUID DISCHARGE HEAD, LIQUID DISCHARGE APPARATUS, AND SUBSTRATE FOR LIQUID DISCHARGE HEAD

BACKGROUND OF THE INVENTION

1. Field of the Invention

The present invention relates to a liquid discharge head which discharges a liquid, a cleaning method for the liquid discharge head, a liquid discharge apparatus, and a substrate for the liquid discharge head.

2. Description of the Related Art

An ink jet head as a typical example of a liquid discharge head includes a plurality of discharge ports for discharging ink, a flow path in communication with the plurality of discharge ports, and an electro-thermal conversion element serving as a thermal energy generation element that generates thermal energy for causing the ink to discharge. The electro-thermal conversion element includes a heat generating resistor, and an electrode for supplying power thereto. An insulation protection layer having electrical insulation properties covers the electro-thermal conversion element, thereby ensuring insulation between the ink and the electro-thermal conversion element. The electro-thermal conversion element is driven to generate thermal energy that rapidly heats the ink to generate bubbles at an ink contact portion (thermal action portion) located above the electro-thermal conversion element, so that the ink is discharged and recording can be executed on a recording medium.

At that time, the thermal action portion of the ink jet head is affected by physical action such as impact arising from cavitation caused by generation and contraction of bubbles, or chemical action caused by the ink. In order to protect the electro-thermal conversion element from the above-described effects, the electro-thermal conversion element is provided with an upper protection layer (upper protection film) made of a metallic material such as a tantalum (Ta) film or a platinum group film (i.e., iridium (Ir) or ruthenium (Ru) film), each of which has relatively strong resistance to the impact arising from the cavitation and the chemical action caused by the ink.

In the thermal action portion which is a contact portion with the ink, a phenomenon occurs in which an additive substance such as a color material included in the ink is decomposed by being heated at high temperature to turn into a low soluble substance and then physically adsorbed onto a surface of the upper protection layer. The above phenomenon is known as "kogation". If a kogation is formed on the thermal action portion of the upper protection layer as described above, thermal conduction from the thermal action portion to the ink becomes uneven, and generation of bubbles becomes unstable. Therefore, the ink discharge characteristics may be affected thereby.

As a method for solving the above issue, Japanese Patent Application Laid-Open No. 2008-105364 discusses a method for removing a kogation from the thermal action portion, in which an upper protection layer is provided to serve as an electrode for causing an electro-chemical reaction with ink so that a surface of the upper protection layer is eluted into the ink by the electro-chemical reaction. Specifically, in order to remove the kogation, a voltage is applied in such a way that the upper protection layer having the thermal action portion serves as an anode electrode, while an electrode arranged in a region other than the region of the thermal action portion within the same ink flow path serves as a cathode electrode.

SUMMARY OF THE INVENTION

According to an aspect of the present invention, a liquid discharge head includes a substrate for the liquid discharge head and a liquid chamber forming member. The substrate for the liquid discharge head includes, a plurality of thermal energy generation elements configured to generate thermal energy for discharging a liquid, an insulation protection layer configured to cover each of the plurality of thermal energy generation elements, and an upper protection film, which is made of a material including at least one of iridium and ruthenium and is disposed corresponding to each of the plurality of thermal energy generation elements, configured to cover at least a region of the insulation protection layer corresponding to each of the plurality of thermal energy generation elements, in this order. The liquid chamber forming member is configured to form, together with the substrate for the liquid discharge head, a liquid chamber in which a plurality of the upper protection films is arranged. In the liquid discharge head, the upper protection film and at least one of the upper protection films adjacent to the upper protection film within the liquid chamber are respectively connected to different external electrodes, and a voltage can be applied therebetween via the different external electrodes.

Further features of the present invention will become apparent from the following description of exemplary embodiments with reference to the attached drawings.

DESCRIPTION OF THE EMBODIMENTS

In a case where an electrode used for removing (cleaning) a kogation is arranged in the ink flow path as described in Japanese Patent Application Laid-Open No. 2008-105364, the size of the substrate for the ink jet head is increased because a space for arranging the electrode is required.

Therefore, the present invention is directed to suppressing an increase in the size of the liquid discharge head caused by arranging electrodes for cleaning the upper protection film. Various exemplary embodiments, features, and aspects of the invention will be described in detail below with reference to the drawings.

<Liquid Discharge Apparatus>

Figure 1:
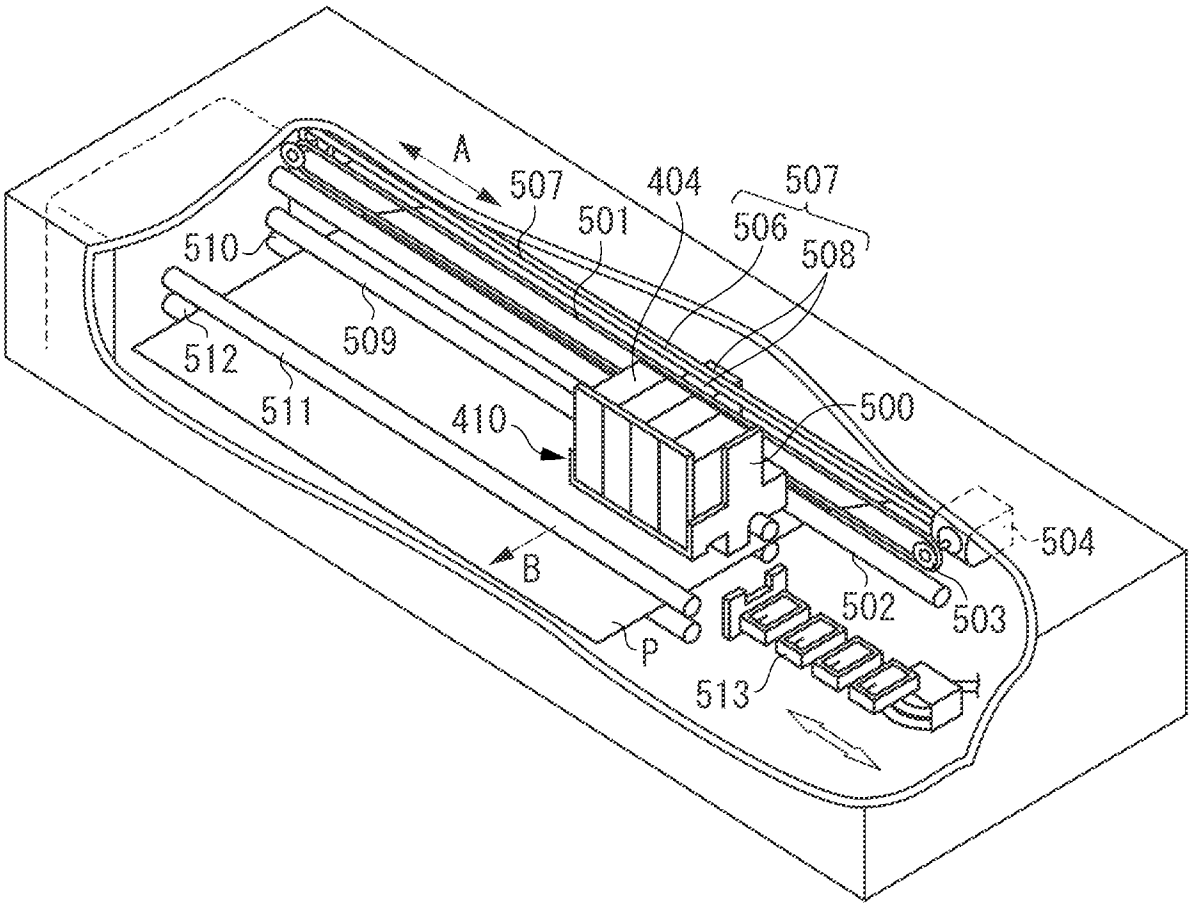
FIG. 1 is a perspective view of an ink jet recording apparatus according to an exemplary embodiment of the present invention.

FIG. 1 is a perspective view schematically illustrating an ink jet recording apparatus serving as a liquid discharge apparatus according to an exemplary embodiment of the present invention. A carriage 500 is supported by a guide 502 in order to perform printing with an ink jet head unit 410 attached thereto. The guide 502 is attached to a chassis to guide and support the carriage 500 so that the carriage 500 reciprocally scans in a direction orthogonal to the conveyance direction of a recording medium. The guide 502 is integrally formed with the chassis and maintains a space between the ink jet head unit 410 and the recording medium by holding the rear end of the carriage 500.

The carriage 500 is driven by a carriage motor 504 attached to the chassis via a timing belt 501. Further, the timing belt 501 is stretched and supported by an idle pulley 503.

When an image is to be formed on a recording medium with the above configuration, a roller pair (not illustrated), including a conveyance roller and a pinch roller, conveys the recording medium to make a positional adjustment with respect to rows. Further, in order to make a positional adjustment with respect to columns, the carriage motor 504 moves the carriage 500 in a direction perpendicular to the above-described conveyance direction to dispose the ink jet head unit 410 on a desired image forming position. The ink jet head 410 to which the positional adjustment has been made discharges ink onto the recording medium while repeating recording main scanning and recording sub-scanning in an alternate manner, so that an image is formed on the recording medium.

<Liquid Discharge Head Unit>

Figure 2:
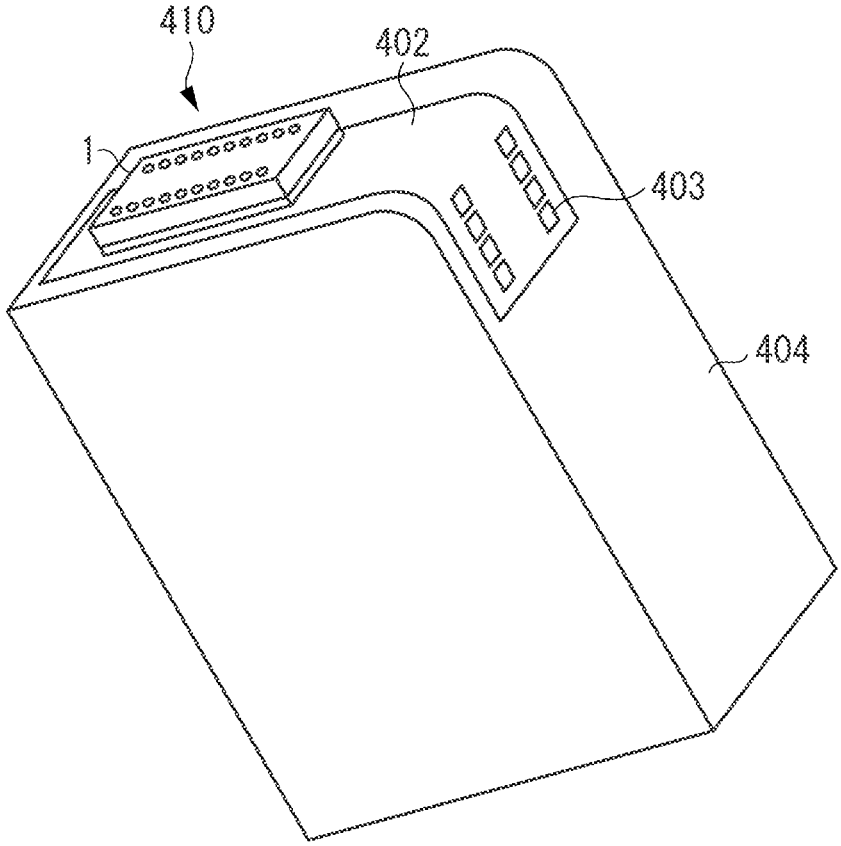
FIG. 2 is a perspective view of an ink jet head unit according to the exemplary embodiment of the present invention.

FIG. 2 is a perspective view of the ink jet head unit 410 serving as a liquid discharge head unit according to the exemplary embodiment of the present invention. The ink jet head unit 410 includes an ink jet head 1, an electric wiring tape 402, and a contact portion (external terminal) 403 that electrically connects the ink jet head unit 410 to the ink jet recording apparatus (recording apparatus main unit).

<Liquid Discharge Head>

Figure 3A:
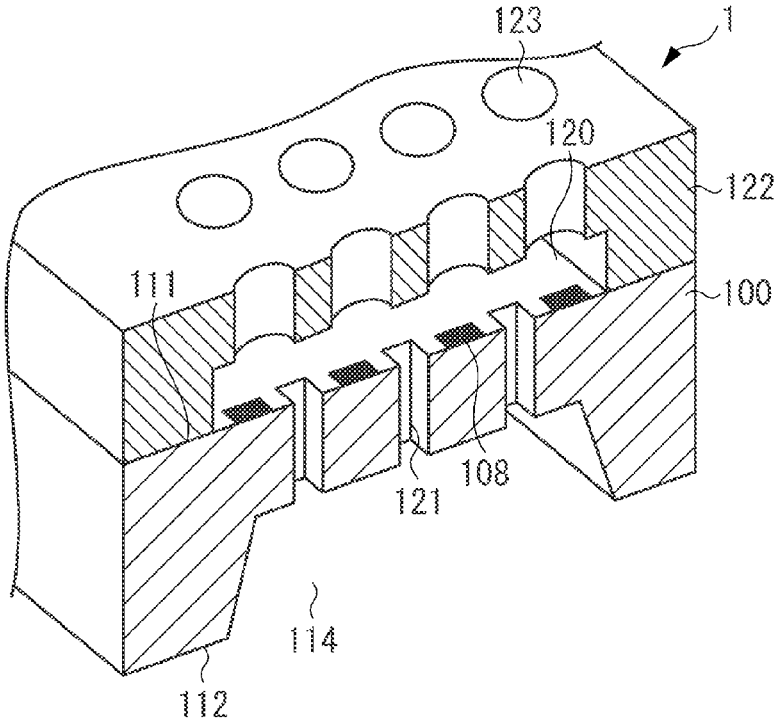
FIGS. 3A and 3B are diagrams illustrating an ink jet head according to the exemplary embodiment of the present invention.

FIG. 3A is a perspective half-sectional view illustrating a part of the ink jet head 1 serving as the liquid discharge head according to the exemplary embodiment of the present invention. The ink jet head 1 includes an ink jet head substrate 100 serving as a substrate for the liquid discharge head and having a first surface 111 and a second surface 112, and a discharge port forming member 122 serving as a liquid chamber forming member and laminated on the side of the first surface 111 of the ink jet head substrate 100.

Figure 3B:
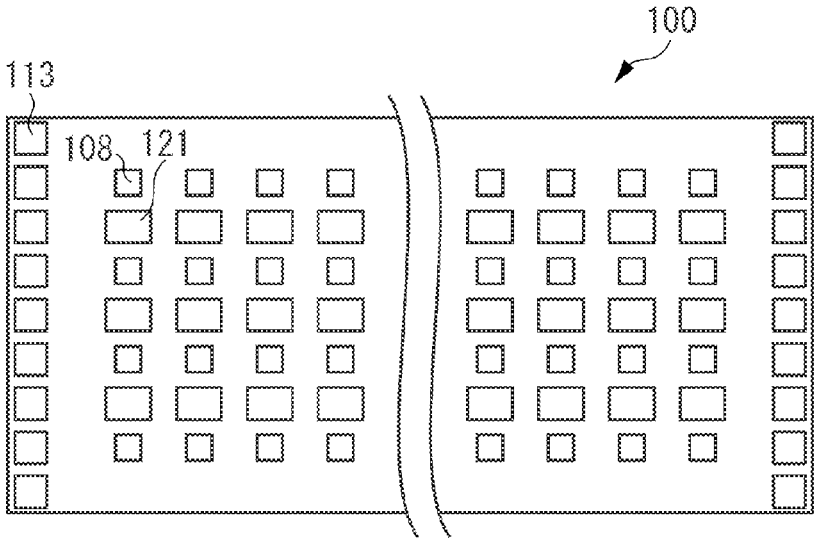

FIG. 3B is a plan view schematically illustrating the ink jet head substrate 100, viewed from the side of the first surface 111. External electrodes 113 are disposed on the first surface 111 of the ink jet head substrate 100, so that the ink jet head 1 is electrically connected to an external portion via the external electrodes 113.

Thermal action portions 108 which make contact with ink and apply thermal energy to the ink for causing it to discharge, and independent ink supply ports 121 which supply ink to the thermal action portions 108 are formed on the side of the first surface 111 of the ink jet head substrate 100. Further, a common ink supply port 114 in communication with a plurality of the independent ink supply ports 121 is formed on the side of the second surface 112 of the ink jet head substrate 100. The independent ink supply ports 121 and the common ink supply port 114 penetrate the first surface 111 and the second surface 112 of the ink jet head substrate 100.

An ink flow path (liquid chamber) 120 formed by the ink jet head substrate 100 and the discharge port forming member 122 is disposed on a space between the ink jet head substrate 100 and the discharge port forming member 122, and the plurality of thermal action portions 108 are disposed within the ink flow path 120. Further, on the discharge port forming member 122 formed by a plurality of resin layers laminated to each other, discharge ports 123 are formed at the positions corresponding to the respective thermal action portions 108. The ink that has been supplied from the common ink supply port 114 through the respective independent ink supply ports 121 passes through the ink flow path 120, so as to be supplied to the plurality of thermal action portions 108. The thermal energy causes the ink on the thermal action portions 108 to bubble up, so that the ink is discharged through the discharge ports 123.

Figure 4:
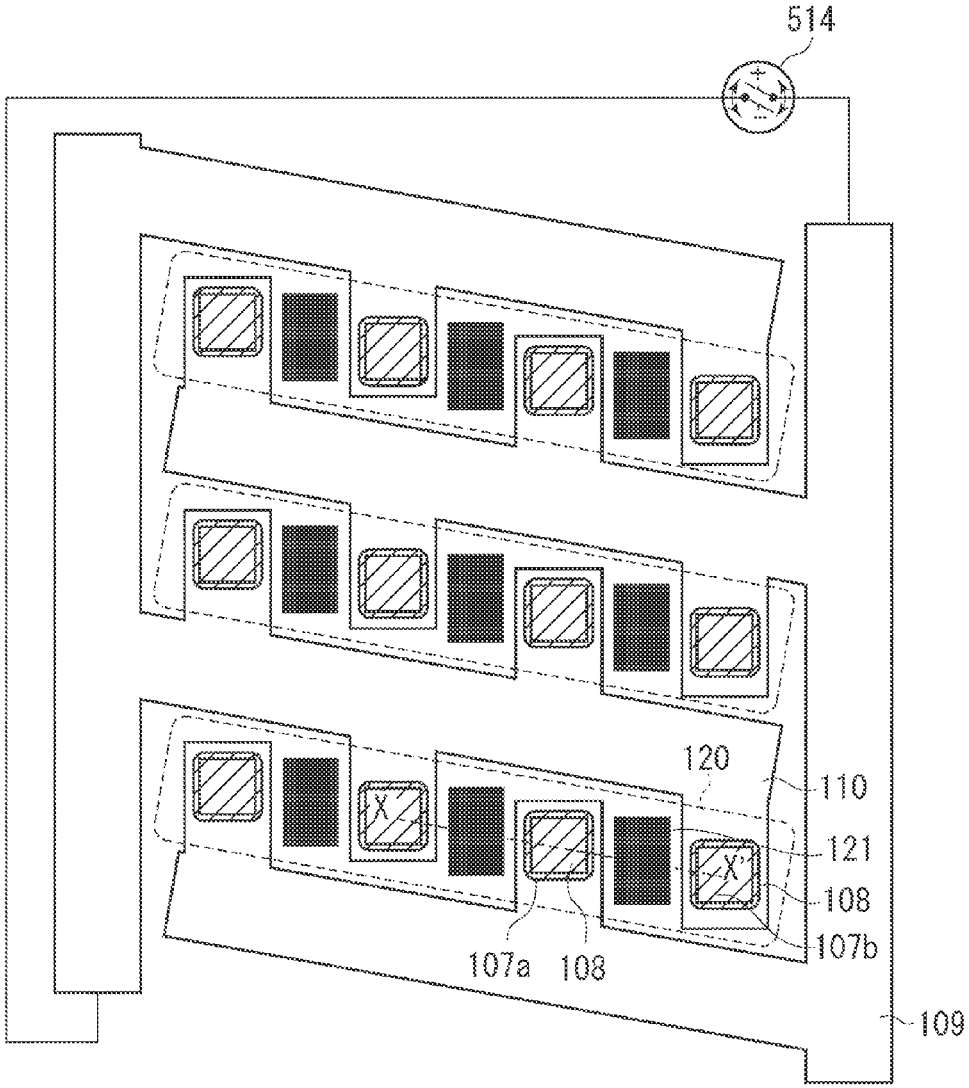
FIG. 4 is a plan view of the ink jet head according to a first exemplary embodiment of the present invention.
Figure 5:
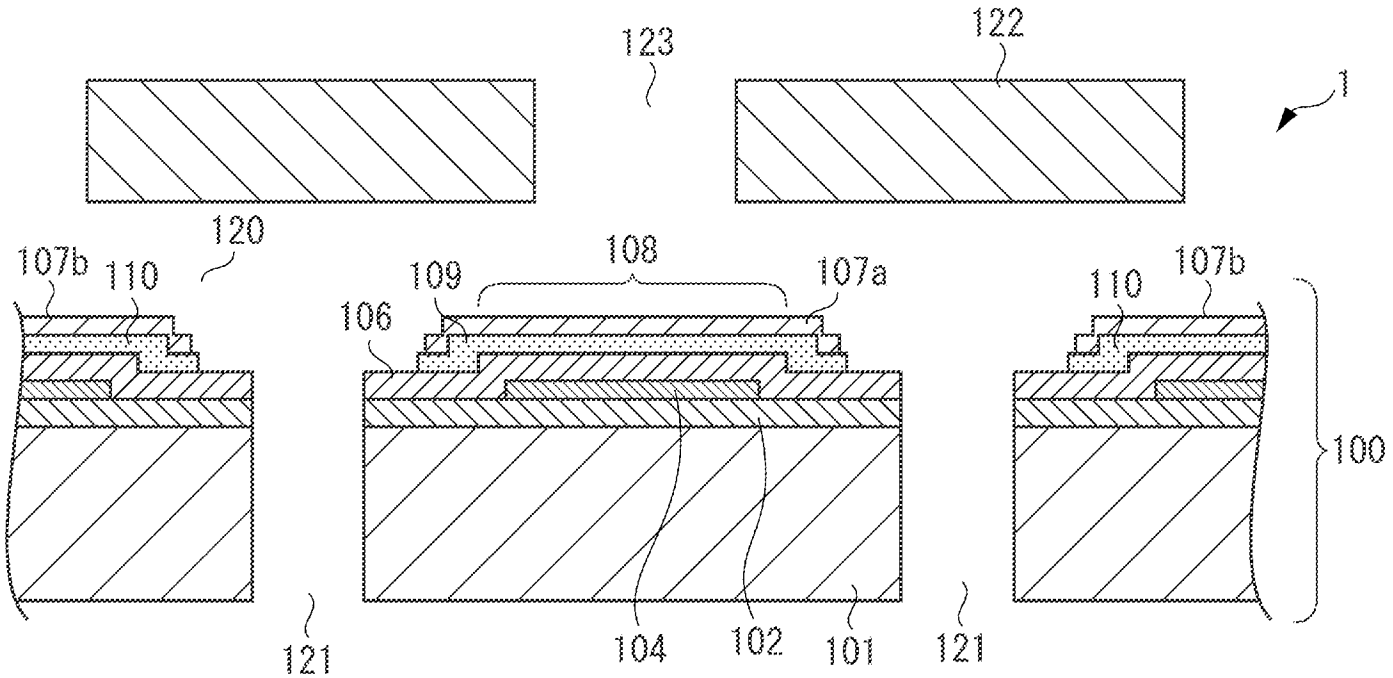
FIG. 5 is a cross-sectional view of the ink jet head according to the first exemplary embodiment of the present invention.

FIG. 4 is a plan view seen from the first surface 111, illustrating a vicinity of the thermal action portions 108 of the ink jet head 1 according to the first exemplary embodiment of the present invention, eliminating the discharge port forming member 122 for the description purpose. FIG. 5 is a cross-sectional view of the ink jet head 1 taken along a line X-X' in FIG. 4.

The independent ink supply ports 121 are arranged on the spaces between a plurality of the thermal action portions 108 adjacent to each other. Further, as indicated by a dashed line in FIG. 4, the plurality of thermal action portions 108 adjacent to each other are arranged within the same ink flow path 120. In the present exemplary embodiment, four thermal action portions 108 are arranged within the same ink flow path 120.

In FIG. 5, the ink jet head substrate 100 includes a silicon substrate 101, a thermal accumulation layer 102 made of, for example, a thermal oxide film, a silicon monoxide (SiO) film, and a silicon nitride (SiN) film, and an electro-thermal conversion element 104. The electro-thermal conversion element 104 includes a heat generating resistor layer made of a material such as tantalum silicon nitride (TaSiN), and an electrode wiring layer serving as wiring that is made of a metallic material such as aluminum (Al), aluminum-silicon (Al—Si), or aluminum-copper (Al—Cu), which is provided on the heat generating resistor layer. Specifically, a part of the electrode wiring layer is removed to form a gap, so that the heat generation resistor layer on the removed portion is exposed to form the electro-thermal conversion element 104 serving as a thermal energy generation element. The electrode wiring layer is connected to a driving element circuit or an external power supply terminal, so as to be capable of receiving external power supply. An insulation protection layer 106 made of a SiO film or a SiN film is provided as an upper layer of the electro-thermal conversion element 104 and the electrode wiring layer.

An upper protection layer (upper protection film) 107 that protects the electro-thermal conversion element 104 from chemical or physical impact arising from heat generation of the electro-thermal conversion element 104 is disposed to cover at least the region of the insulation protection layer 106 that corresponds to the electro-thermal conversion element 104. A portion of the upper protection layer 107 corresponding to the electro-thermal conversion element 104 serves as the thermal action portion 108, and the thermal energy generated by the electro-thermal conversion element 104 is applied to the ink through the thermal action portion 108.

In addition, the upper protection layer 107 is also used as an electrode for removing a kogation formed on the surface of the thermal action portion 108 due to use of the ink jet head 1. In the present exemplary embodiment, metal to be eluted by an electro-chemical reaction in the ink, in particular, iridium (Ir) is used as the upper protection layer 107 that makes contact with the ink. Because Ir has a characteristic of not forming an oxide film in the atmosphere having a temperature up to 800° C., the elution of the upper protection layer 107 into the ink caused by the electro-chemical reaction cannot be interfered even if thermal energy is generated by the electro-thermal conversion element 104 when the ink jet head 1 is in use. In addition, a material other than Ir, such as ruthenium (Ru), an iridium alloy, or a ruthenium alloy may be used for the upper protection layer 107 as long as the material includes at least one of Ir and Ru.

Generally, Ir used for the upper protection layer 107 has low adhesion to the insulation protection layer 106. Therefore, in order to enhance the adhesion between the upper protection layer 107 and the insulation protection layer 106, adhesive layers 109 and 110 serving as intermediate layers, made of a material such as Ta, are disposed between the insulation protection layer 106 and the upper protection layer 107. Further, the adhesive layers 109 and 110 include wiring portions for electrically connecting the upper protection layer 107 to an external electrode, so that a material having electric conductivity is used to form the adhesive layers 109 and 110. The adhesive layers 109 and 110 are inserted into through-holes provided on the insulation protection layer 106, so as to be connected to the electrode wiring layer. A part of the electrode wiring layer forms the external electrodes 113 (see FIG. 3B) for making electric connection with an external portion. The external electrodes 113 are electrically connected to the recording apparatus main unit via the above-described electric wiring tape 402 and the contact portion 403 (see FIG. 2), so that a voltage can be applied to the upper protection layer 107.

As illustrated in FIG. 4, the ink jet head substrate 100 is provided with the adhesive layers 109 and 110. These adhesive layers 109 and 110 do not have electrical connection on the ink jet head substrate 100, and are respectively connected to different external electrodes, i.e., a first external electrode and a second external electrode. An upper protection layer 107*a* (first upper protection film) and an upper protection layer 107*b* (second upper protection film) which respectively correspond to two adjacent electro-thermal conversion elements 104 (first thermal energy generation element and second thermal energy generation element) are disposed on the same ink flow path 120. In addition, the upper protection layers 107*a* and 107*b* are in communication with each other within the ink flow path 120. Then, the upper protection layer 107*a* is connected to the adhesive layer 109, whereas the upper protection layer 107*b* is connected to the adhesive layer 110. In other words, the upper protection layer 107*a* and the upper protection layer 107*b* are respectively connected to different external electrodes, so that a voltage can be applied therebetween via the different external electrodes.

Then, in order to remove a kogation from the thermal action portion 108 of the upper protection layer 107*a*, the upper protection layer 107*b* adjacent to the upper protection layer 107*a* is used as the other electrode. In other words, a voltage applying unit 514 disposed on the recording apparatus main unit applies a voltage through the external electrodes in such a way that the upper protection layer 107*a* serves as an anode electrode while the upper protection layer 107*b* serves as a cathode electrode. With this configuration, an electrochemical reaction occurs between the ink and the upper protection layer 107*a*, so as to remove the kogation by causing a surface of the upper protection layer 107*a* to be eluded into the ink together with the kogation. Thereafter, a voltage is applied by reversing the polarities of the upper protection layers 107*a* and 107*b*, so that the surface of the upper protection layer 107*b* is eluded into the ink together with the kogation, and thus the kogation thereon is also removed.

As described above, since the adjacent upper protection layers 107*a* and 107*b* are in communication with each other within the ink flow path 120, the upper protection layers 107*a* and 107*b* can mutually serve as the electrodes for removing a kogation. In the present exemplary embodiment, a wall having a surface in a direction intersecting with the arrangement direction of the upper protection layers 107*a* and 107*b* is not disposed between the upper protection layers 107*a* and 107*b*. Other configuration may be applicable as long as each of the upper protection layers 107*a* and 107*b* can mutually serve as the electrodes for removing a kogation. Therefore, a filter for catching foreign particles may be disposed on a region between the upper protection layers 107*a* and 107*b*, for example.

As described above, according to the present exemplary embodiment, the adjacent upper protection layers 107*a* and 107*b*, disposed within the same ink flow 120, are respectively connected to different external electrodes. Then, in order to remove a kogation from the upper protection layer 107*a*, the upper protection layer 107*b* is used as an electrode for removing the kogation. Accordingly, an electrode dedicated for removing a kogation does not have to be disposed within the ink flow path 120, and thus the upsizing of the ink jet head substrate 100 can be suppressed.

With the above configuration, a decrease in the number of substrates produced from a wafer caused by an increase in the size of the ink jet head substrate 100 is suppressed, and thus the production cost of the ink jet head 1 can be prevented from being increased. In a case where an electrode dedicated for removing a kogation is disposed on the space between the independent ink supply port 121 and the thermal action portion 108, the distance between the independent ink supply port 121 and the thermal action portion 108 is longer, which causes an increase in the ink-supplying time, resulting in lowering the discharge performance of the ink jet head 1. However, with the above-described configuration, lowering the discharge performance of the ink jet head 1 caused thereby can be prevented.

Further, in the present exemplary embodiment, as illustrated in FIG. 4, the independent ink supply port 121 is provided on the space between the thermal action portions 108 that are adjacent to each other within the same ink flow path 120. Therefore, when a kogation on the thermal action portions 108 is to be removed, the ink can be stably supplied to any of the upper protection layers 107. When an operation for removing the kogation is performed, the ingredients of the ink are changed by an electro-chemical reaction. However, because the ink is supplied thereto in such a stable manner, the change of the ingredients of the ink is suppressed, and thus cleaning of the ink jet head 1 can be performed more stably.

Figure 6:
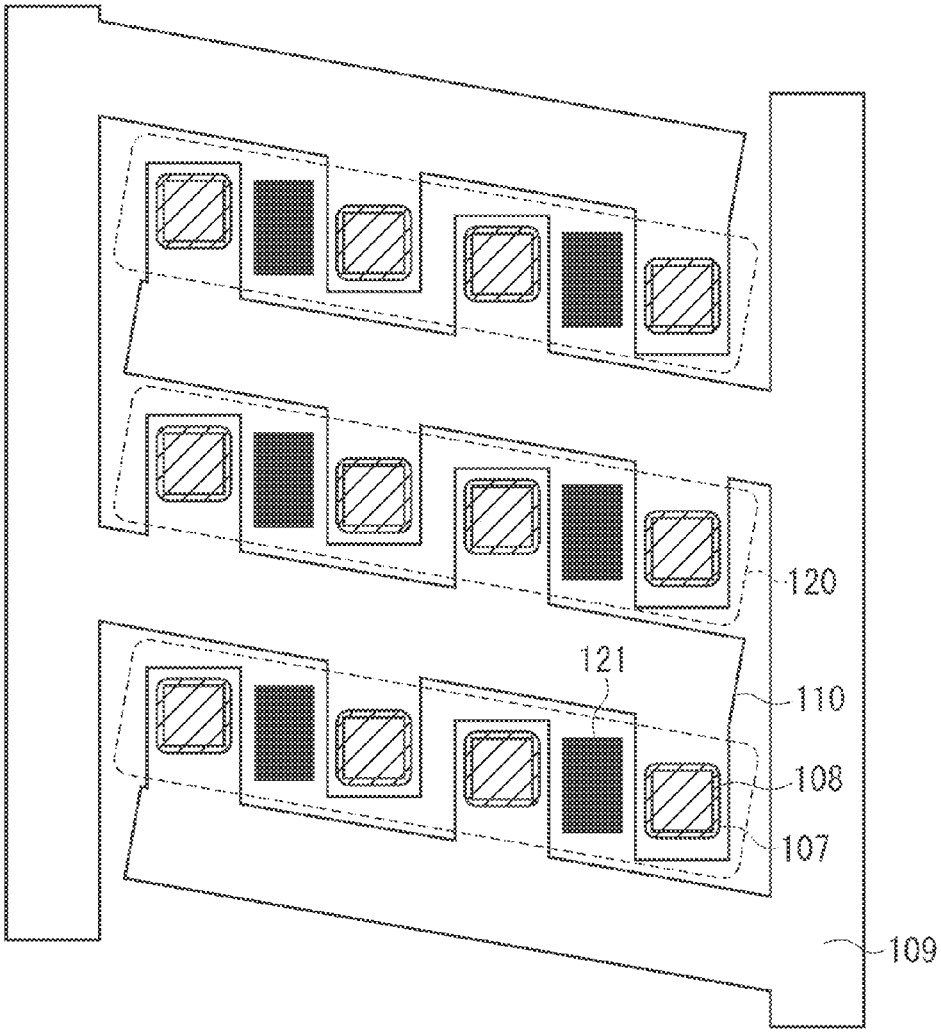
FIG. 6 is a plan view illustrating a modification example of the ink jet head according to the first exemplary embodiment of the present invention.

FIG. 6 is a diagram illustrating a modification example of the present exemplary embodiment. In this modification example, the number of the independent ink supply ports 121 is smaller than that in the above-described configuration, and the independent ink supply ports 121 are not provided on some of the spaces between the adjacent thermal action portions 108. With this configuration, spaces where the independent ink supply ports 121 are disposed can be reduced, so that the size of the ink jet head substrate 100 can be further reduced. Note that at least one independent ink supply port 121 may be formed for the ink flow path 120.

Further, according to the present exemplary embodiment, a single electro-thermal conversion element 104 is disposed for a single discharge port 123. However, the configuration may be such that a plurality of the electro-thermal conversion elements 104 is provided for a single discharge port 123. In this configuration, the adjacent upper protection layers 107 disposed within the ink flow path 120 can also mutually serve as the electrodes for removing a kogation, as described above.

Figure 7:
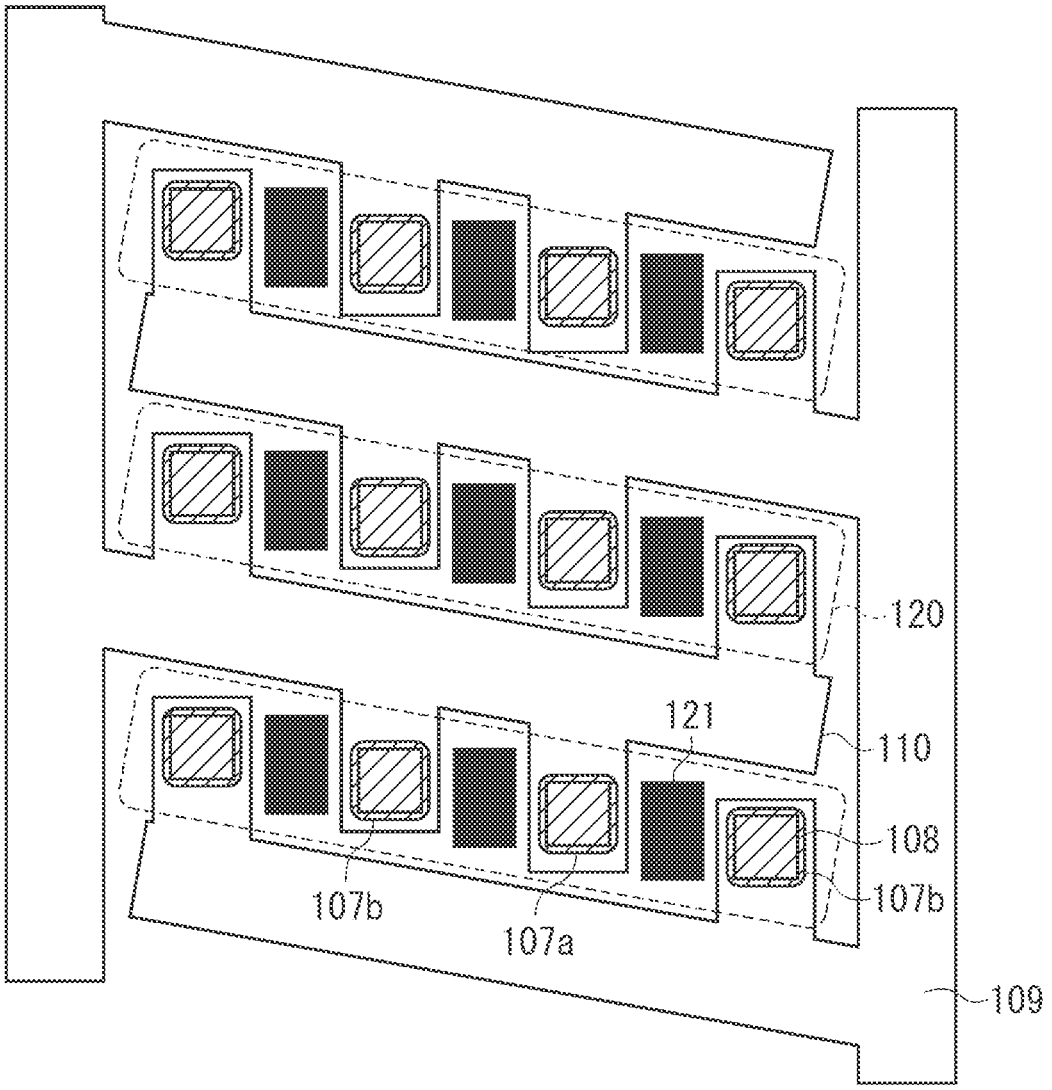
FIG. 7 is a plan view of an ink jet head according to a second exemplary embodiment of the present invention.

FIG. 7 is a plan view seen from the first surface 111, illustrating a vicinity of the thermal action portions 108 of the ink jet head 1 according to a second exemplary embodiment of the present invention, eliminating the discharge port forming member 122 for the description purpose.

In the present exemplary embodiment, the arrangement configuration of the upper protection layers 107 and the adhesive layers 109 and 110 are different from that described in the first exemplary embodiment. In the first exemplary embodiment, a plurality of the upper protection layers 107 is alternately connected to different adhesive layers 109 and 110 in the arrangement direction of the upper protection layers 107 within the ink flow path 120. On the other hand, in the present exemplary embodiment, of the two upper protection layers 107*b* disposed on both sides of the upper protection layer 107*a* within the ink flow path 120, one upper protection layer 107*b* is connected to the external electrode that is different from that connected to the upper protection layer 107*a*, whereas the other upper protection layer 107*b* is connected to the external electrode that is the same as that connected to the upper protection layer 107*a*.

Therefore, in the present exemplary embodiment, with respect to any of the upper protection layers 107 disposed within the same ink flow path 120, an upper protection layer 107 connected to a different external electrode is disposed on only one side thereof. Accordingly, a kogation can be equally removed from any of the upper protection layers 107, and thus cleaning of the ink jet head 1 can be performed more stably.

Figure 8:
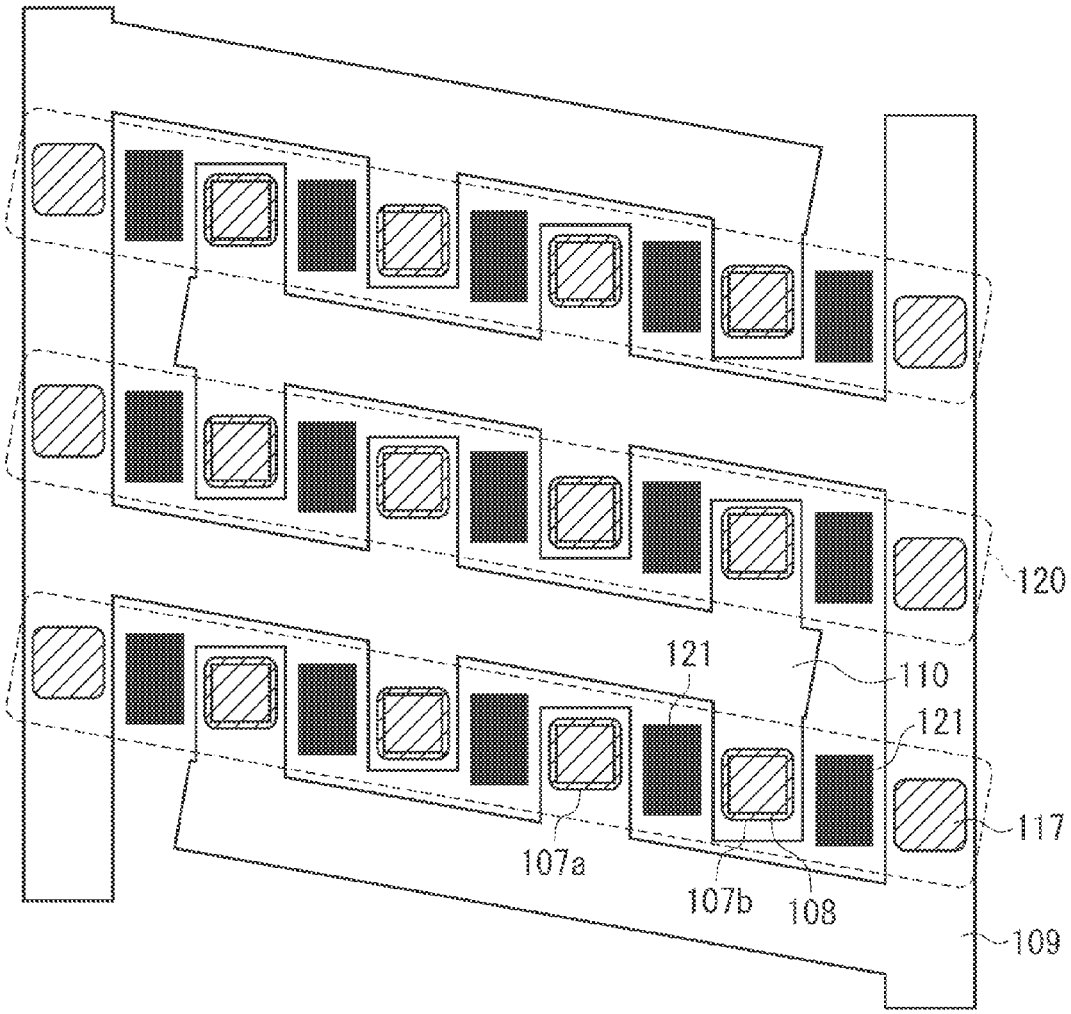
FIG. 8 is a plan view of an ink jet head according to a third exemplary embodiment of the present invention.

FIG. 8 is a plan view seen from the first surface 111, illustrating a vicinity of the thermal action portions 108 of the ink jet head 1 according to a third exemplary embodiment of the present invention. The discharge port forming member 122 is not illustrated for the simplification of description.

In the present exemplary embodiment, in addition to the configuration described in the first exemplary embodiment, electrodes 117 dedicated for removing a kogation are disposed on the positions adjacent to the upper protection layers 107*b* disposed on the end portions in the arrangement direction of the upper protection layers 107 within the ink flow paths 120. As illustrated in FIG. 8, the electrodes 117 are disposed on the end portions of the ink flow paths 120. Although the electrodes 117 are made of the same material as that for the upper protection layers 107, the electro-thermal conversion elements 104 are not formed on the lower layers thereof.

As described above, in the present exemplary embodiment, the upper protection layer 107 connected to a different external electrode, or the electrode 117 dedicated for removing a kogation is disposed on both sides of each of the upper protection layers 107. Accordingly, a kogation can be equally removed from any of the upper protection layers 107, and thus cleaning of the ink jet head 1 can be performed more stably.

According to the exemplary embodiment of the present invention, it is possible to suppress an increase in the size of the liquid discharge head caused by arranging electrodes for cleaning the upper protection films.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-081552 filed Apr. 9, 2013, which is hereby incorporated by reference herein in its entirety.

What is claimed is:

1. A liquid discharge head comprising:

a substrate for the liquid discharge head including, a plurality of thermal energy generation elements configured to generate thermal energy for discharging a liquid, an insulation protection layer configured to cover each of the plurality of thermal energy generation elements, and an upper protection film, which is made of a material including at least one of iridium and ruthenium and is disposed corresponding to each of the plurality of thermal energy generation elements, configured to cover at least a region of the insulation protection layer corresponding to each of the plurality of thermal energy generation elements, in this order; and a liquid chamber forming member configured to form, together with the substrate for the liquid discharge head, a liquid chamber in which a plurality of the upper protection films is arranged, wherein the upper protection film and at least one of the upper protection films adjacent to the upper protection film within the liquid chamber are respectively connected to different external electrodes, and a voltage can be applied therebetween via the different external electrodes.

2. A liquid discharge head comprising:

a substrate for the liquid discharge head including, a plurality of thermal energy generation elements configured to generate thermal energy for discharging a liquid, an insulation protection layer configured to cover each of the plurality of thermal energy generation elements, and an upper protection film, which is made of a material that is to be eluted by an electrochemical reaction with a liquid as well as does not form, with the thermal energy generated by the plurality of thermal energy generation elements, an oxide film that prevents the upper protection film from being eluted and which is disposed corresponding to each of the plurality of thermal energy generation elements, configured to cover at least a region of the insulation protection layer corresponding to each of the plurality of thermal energy generation elements, in this order; and a liquid chamber forming member configured to form, together with the substrate for the liquid discharge head, a liquid chamber in which a plurality of the upper protection films is arranged, wherein the upper protection film and at least one of the upper protection films adjacent to the upper protection film within the liquid chamber are respectively connected to different external electrodes, and a voltage can be applied therebetween via the different external electrodes.

3. The liquid discharge head according to claim 1, wherein the upper protection films adjacent to each other within the liquid chamber are in communication with each other within the liquid chamber.

4. The liquid discharge head according to claim 1, wherein the liquid chamber forming member includes discharge ports respectively corresponding to the plurality of thermal energy generation elements.

5. The liquid discharge head according to claim 1, wherein, among the plurality of upper protection films arranged within the liquid chamber, a first upper protection film is disposed between a plurality of second upper protection films, and wherein the first upper protection film and only one of the plurality of second upper protection films are respectively connected to the different external electrodes.

6. The liquid discharge head according to claim 1, wherein the plurality of upper protection films arranged within the liquid chamber is alternately connected to a first external electrode and a second external electrode different from the first external electrode, in an arrangement direction of the plurality of upper protection films.

7. The liquid discharge head according to claim 6, wherein an electrode, which is made of a material including at least one of iridium and ruthenium and allows a voltage to be applied between the electrode and an upper protection film disposed at an end among the plurality of upper protection films within the liquid chamber, is arranged adjacent to the upper protection film disposed at the end within the liquid chamber.

8. The liquid discharge head according to claim 1, wherein intermediate layers made of a material having electrical conductivity are respectively disposed between the insulation protection layer and the plurality of upper protection films, and wherein the plurality of upper protection films are connected to the external electrodes via the intermediate layers.

9. The liquid discharge head according to claim 1, wherein a supply port for supplying a liquid to the liquid chamber is disposed between the upper protection films that are adjacent to each other within the liquid chamber.

10. The liquid discharge head according to claim 9, wherein a supply port for supplying a liquid to a plurality of the supply ports is disposed on the liquid discharge head.

11. A liquid discharge head comprising:

a substrate for the liquid discharge head including a first thermal energy generation element and a second thermal energy generation element, adjacent to each other, configured to generate thermal energy for discharging a liquid, an insulation protection layer configured to cover each of the first thermal energy generation element and the second thermal energy generation element, and a first upper protection film and a second upper protection film that are made of a material including at least one of iridium and ruthenium, the first upper protection film being configured to cover at least a region of the insulation protection layer corresponding to the first thermal energy generation element and the second upper protection film being configured to cover at least a region of the insulation protection layer corresponding to the second thermal energy generation element; and a liquid chamber forming member configured to form, together with the substrate for the liquid discharge head, a liquid chamber in which the first upper protection film and the second upper protection film are arranged, wherein the first upper protection film and the second upper protection film are respectively connected to different external electrodes, and a voltage can be applied therebetween via the different external electrodes.

12. The liquid discharge head according to claim 2, wherein the upper protection films adjacent to each other within the liquid chamber are in communication with each other within the liquid chamber.

13. The liquid discharge head according to claim 2, wherein the liquid chamber forming member includes discharge ports respectively corresponding to the plurality of thermal energy generation elements.

14. The liquid discharge head according to claim 2, wherein, among the plurality of upper protection films arranged within the liquid chamber, a first upper protection film is disposed between a plurality of second upper protection films, and wherein the first upper protection film and only one of the plurality of second upper protection films are respectively connected to the different external electrodes.

15. The liquid discharge head according to claim 2, wherein the plurality of upper protection films arranged within the liquid chamber is alternately connected to a first external electrode and a second external electrode different from the first external electrode, in an arrangement direction of the plurality of upper protection films.

16. The liquid discharge head according to claim 15, wherein an electrode, which is made of a material including at least one of iridium and ruthenium and allows a voltage to be applied between the electrode and an upper protection film disposed at an end among the plurality of upper protection films within the liquid chamber, is arranged adjacent to the upper protection film disposed at the end within the liquid chamber.

17. The liquid discharge head according to claim 2, wherein intermediate layers made of a material having electrical conductivity are respectively disposed between the insulation protection layer and the plurality of upper protection films, and wherein the plurality of upper protection films are connected to the external electrodes via the intermediate layers.

18. The liquid discharge head according to claim 2, wherein a supply port for supplying a liquid to the liquid chamber is disposed between the upper protection films that are adjacent to each other within the liquid chamber.

19. The liquid discharge head according to claim 18, wherein a supply port for supplying a liquid to a plurality of the supply ports is disposed on the liquid discharge head.

20. The liquid discharge head according to claim 3, wherein intermediate layers made of a material having electrical conductivity are respectively disposed between the insulation protection layer and the plurality of upper protection films, and wherein the plurality of upper protection films are connected to the external electrodes via the intermediate layers.

* * * * *